US009617832B2

(12) United States Patent
Butler et al.

(10) Patent No.: US 9,617,832 B2
(45) Date of Patent: Apr. 11, 2017

(54) VARIABLE DIAMETER BULLNOSE ASSEMBLY

(71) Applicant: Halliburton Energy Services, Inc., Houston, TX (US)

(72) Inventors: Benjamin Luke Butler, North Perth (AU); Cole Alexander Benson, West Leederville (AU)

(73) Assignee: Halliburton Energy Services, Inc., Houston, TX (US)

( * ) Notice: Subject to any disclaimer, the term of this patent is extended or adjusted under 35 U.S.C. 154(b) by 236 days.

(21) Appl. No.: 14/386,361

(22) PCT Filed: Dec. 9, 2013

(86) PCT No.: PCT/US2013/073779
§ 371 (c)(1),
(2) Date: Sep. 19, 2014

(87) PCT Pub. No.: WO2015/088469
PCT Pub. Date: Jun. 18, 2015

(65) Prior Publication Data

US 2016/0245046 A1 Aug. 25, 2016

(51) Int. Cl.
*E21B 41/00* (2006.01)
*E21B 23/12* (2006.01)
(Continued)

(52) U.S. Cl.
CPC ..... *E21B 41/0035* (2013.01); *E21B 17/006* (2013.01); *E21B 23/002* (2013.01)

(58) Field of Classification Search
CPC .... E21B 41/0035; E21B 7/061; E21B 23/002; E21B 17/006
See application file for complete search history.

(56) References Cited

U.S. PATENT DOCUMENTS 5,353,876 A * 10/1994 Curington ..... E21B 7/061 166/313
5,785,125 A * 7/1998 Royer ..... E21B 17/1021 166/241.1
(Continued)

FOREIGN PATENT DOCUMENTS

WO 2015088469 A1 6/2015

OTHER PUBLICATIONS

International Search Report and Written Opinion for PCT/US2013/073779 dated Sep. 3, 2014.

*Primary Examiner* — Giovanna C Wright
*Assistant Examiner* — Kristyn Hall
(74) *Attorney, Agent, or Firm* — McDermott Will & Emery LLP

(57) ABSTRACT

Disclosed are expandable bullnose assemblies. One bullnose assembly includes a body and a bullnose tip arranged at a distal end of the body, a compression ring arranged about an exterior of the body and configured to axially translate with respect to the body upon being actuated, and a plurality of collet fingers coupled to and extending between the compression ring and the bullnose tip, each collet finger being pre-compressed such that each collet finger is predisposed to bow radially outwards, wherein, when the compression ring is actuated, the plurality of collet fingers move radially outward from a first diameter to a second diameter that is greater than the first diameter.

23 Claims, 7 Drawing Sheets

(51) Int. Cl.
*E21B 17/00* (2006.01)
*E21B 23/00* (2006.01)

(56) References Cited

U.S. PATENT DOCUMENTS

| | | | | |
|---|---|---|---|---|
| 6,237,683 | B1 * | 5/2001 | Pringle | E21B 17/028 137/870 |
| 2003/0205379 | A1 | 11/2003 | Steele et al. | |
| 2004/0011529 | A1 | 1/2004 | McGarian et al. | |
| 2005/0121190 | A1 | 6/2005 | Oberkircher et al. | |
| 2009/0145596 | A1 | 6/2009 | Hansen et al. | |
| 2013/0175047 | A1 | 7/2013 | Steele et al. | |

* cited by examiner

VARIABLE DIAMETER BULLNOSE ASSEMBLY

This application is a National Stage entry of and claims priority to International Application No. PCT/US2013/073779, filed on Dec. 9, 2013, Entitled Variable Diameter Bullnose Assembly.

BACKGROUND

The present disclosure relates generally to downhole tools and, more particularly, to an expandable bullnose assembly.

During the construction, completion, and/or intervention of wells in the oil and gas industry, well operators often use bullnose assemblies to tag, deflect, jet or otherwise physically interact with various downhole tools within a wellbore. The ability to use a particular bullnose assembly is limited by its outer diameter, which must be able to pass through restrictions in the wellbore or completion above the intended engagement.

In some cases, the bullnose assembly is used to direct a tool string to a desired location within a wellbore. For instance, some wellbores include one or more lateral wellbores that extend at an angle from a parent or main wellbore. Such wellbores are commonly referred to as multilateral wellbores. Various devices and downhole tools can be installed in a multilateral wellbore in order to direct a tool string toward a particular lateral wellbore. A deflector or whipstock, for example, is a device that can be positioned in the main wellbore at a junction within the main wellbore and configured to direct a bullnose assembly conveyed downhole toward a lateral wellbore that extends from the main wellbore at the junction. Depending on various parameters of the bullnose assembly, some deflectors also allow the bullnose assembly to remain within the main wellbore and otherwise bypass the junction without being directed into the lateral wellbore.

Accurately directing the bullnose assembly into the main wellbore or the lateral wellbore can often be a difficult undertaking. For instance, accurate selection between wellbores commonly requires that both the deflector and the bullnose assembly be correctly oriented within the well and otherwise requires assistance from known gravitational forces. Moreover, conventional bullnose assemblies are typically only able to enter a lateral wellbore at a junction where the design parameters of the deflector correspond to the design parameters of the bullnose assembly. In order to enter another lateral wellbore at a junction having a differently designed deflector, the bullnose assembly must be returned to the surface and replaced with a bullnose assembly exhibiting design parameters corresponding to the differently designed deflector. As can be appreciated, this process can be time consuming and costly.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to downhole tools and, more particularly, to an expandable bullnose assembly.

Disclosed is a bullnose assembly that is able to expand its outer diameter on demand downhole such that it is able to be accurately deflected into either a main wellbore or a lateral wellbore using a correspondingly designed deflector. The deflector has a first channel that communicates to lower portions of the main wellbore, and a second channel that communicates with the lateral wellbore. If the diameter of the bullnose assembly is smaller than the diameter of the first channel, the bullnose assembly will be directed into the lower portions of the main wellbore. Alternatively, if the diameter of the bullnose assembly is larger than the diameter of the first channel, the bullnose assembly will be directed into the lateral wellbore. The variable nature of the disclosed bullnose assemblies allows for selective and repeat re-entry of any number of stacked multilateral wells having multiple junctions that are each equipped with the deflector.

Moreover, there are several practical applications for a variable diameter bullnose assembly as disclosed herein. In one such embodiment, a bullnose assembly can pass through a restriction in a completion and increase its outer diameter in order to shift a downhole tool, such as a sleeve, between open and closed positions. In another embodiment, a bullnose assembly at the end of a work string can increase its outer diameter in order to tag a depth reference and subsequently decrease its outer diameter in order to allow the bullnose assembly to be pulled through a restriction. The variable outer diameter bullnose assembly may also have practical application in fracture stimulation completions, where it could be utilized to shift open/closed frac sleeves without the requirement to drop balls.

Figure 1:
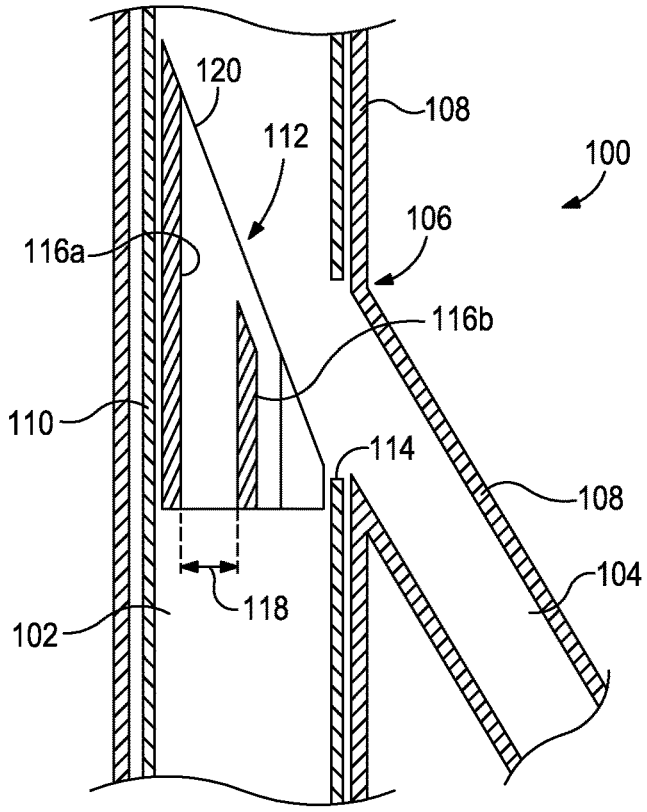
FIG. 1 illustrates an exemplary well system that may employ one or more principles of the present disclosure, according to one or more embodiments.

Referring to FIG. 1, illustrated is an exemplary well system 100 that may employ one or more principles of the present disclosure, according to one or more embodiments. The well system 100 includes a main bore 102 and a lateral bore 104 that extends from the main bore 102 at a junction 106 in the well system 100. The main bore 102 may be a wellbore drilled from a surface location (not shown), and the lateral bore 104 may be a lateral or deviated wellbore drilled at an angle extending from the main bore 102. While the main bore 102 is shown as being oriented vertically, the main bore 102 may be oriented generally horizontal or at any angle between vertical and horizontal, without departing from the scope of the disclosure.

In some embodiments, the main bore 102 may be lined with a casing string 108 or the like, as illustrated. The lateral bore 104 may also be lined with casing string 108. In other embodiments, however, the casing string 108 may be omitted from the lateral bore 104 such that the lateral bore 104 may be formed as an "open hole" section, without departing from the scope of the disclosure.

In some embodiments, a tubular string 110 may be extended within the main bore 102 and a deflector 112 may be arranged within or otherwise form an integral part of the tubular string 110 at or near the junction 106. The tubular string 110 may be a work string extended downhole within the main bore 102 from the surface location and may define or otherwise provide a window 114 therein such that downhole tools or the like may exit the tubular string 110 into the lateral bore 104. In other embodiments, the tubular string 110 may be omitted and the deflector 112 may instead be generally arranged within the casing string 108, without departing from the scope of the disclosure.

The deflector 112 may be used to direct or otherwise guide a bullnose assembly (not shown) either further downhole within the main bore 102, or into the lateral bore 104. To accomplish this, the deflector 112 may include a first channel 116*a* and a second channel 116*b*. The first channel 116*a* may exhibit a predetermined width or diameter 118. Any bullnose assemblies that have a diameter that is smaller than the predetermined diameter 118 may be directed into the first channel 116*a* and subsequently to lower portions of the main bore 102. In contrast, bullnose assemblies that have a diameter that is greater than the predetermined diameter 118 may be directed into the lateral bore 104 by slidingly engaging a ramped surface 120 that forms an integral part or extension of the second channel 116*b*. The ramped surface 120 serves to guide or direct the bullnose assembly into the lateral bore 104.

Figure 2A:
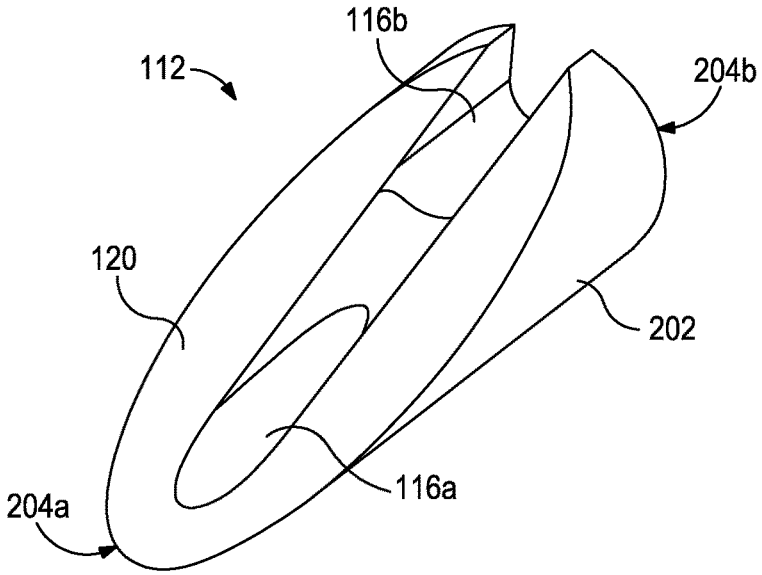
FIGS. 2A-2C illustrate isometric, top, and end views, respectively, of the deflector of FIG. 1, according to one or more embodiments.
Figure 2B:
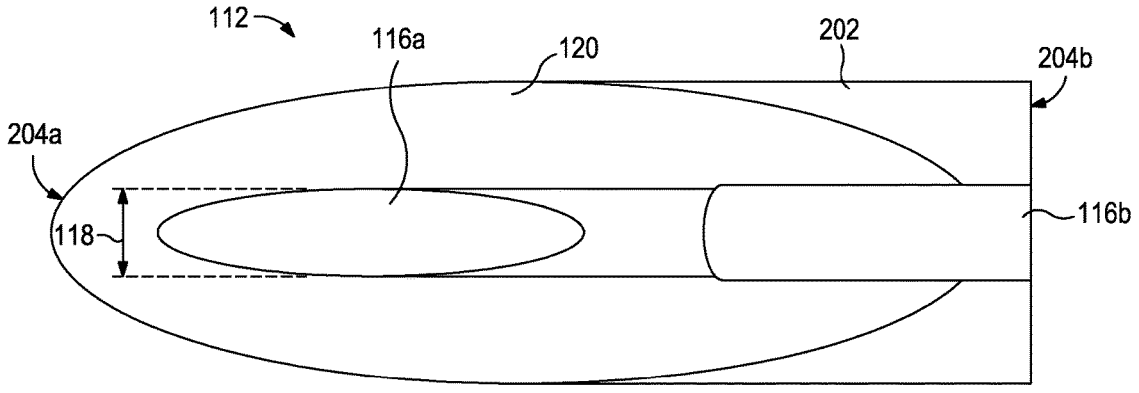
Figure 2C:
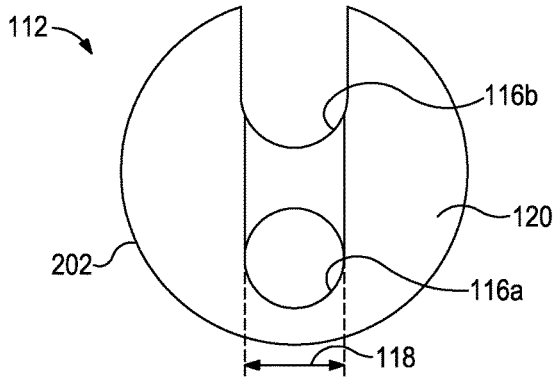

Referring now to FIGS. 2A-2C, with continued reference to FIG. 1, illustrated are isometric, top, and end views, respectively of the exemplary deflector 112 of FIG. 1, according to one or more embodiments. The deflector 112 may have a body 202 that provides a first end 204*a* and a second end 204*b*. The first end 204*a* may be arranged on the uphole end (i.e., closer to the surface of the wellbore) of the main bore 102 (FIG. 1) and the second end 204*b* may be arranged on the downhole end (i.e., closer to the toe of the wellbore) of the main bore 102. FIG. 2C, for example, is a view of the deflector 112 looking at the first end 204*a* thereof.

As illustrated, the first and second channels 116*a,b* and the ramped surface 120 (not shown in FIG. 2C) are defined in or otherwise provided by the deflector 112, as generally described above. As illustrated best in FIG. 2B, the ramped surface 120 generally extends from the first end 204*a* to the second channel 116*b* and otherwise forms an integral part or portion thereof. The first channel 116*a* extends axially through the ramped surface 120 and exhibits the predetermined diameter 118, as generally discussed above. Accordingly, any bullnose assemblies (not shown) having a diameter smaller than the predetermined diameter 118 may be allowed to penetrate the ramped surface 120 and be guided into the first channel 116*a* and subsequently to lower portions of the main bore 102. In contrast, bullnose assemblies having a diameter greater than the predetermined diameter 118 will engage and ride up the ramped surface 120 and be guided into the second channel 116*b* which feeds the lateral bore 104 (FIG. 1).

Figure 3A:
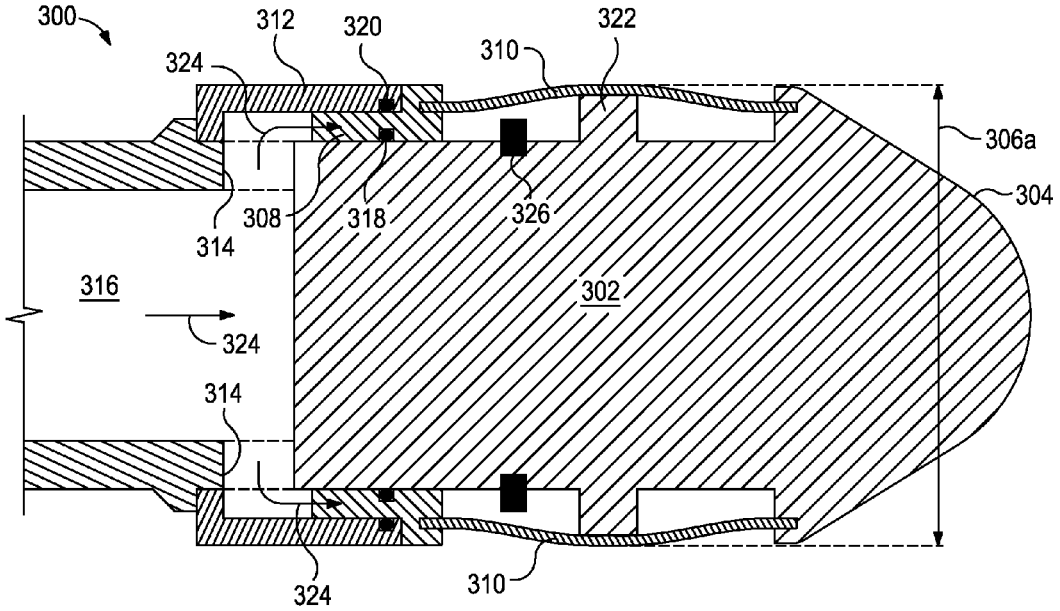
FIGS. 3A and 3B illustrate cross-sectional side views of an exemplary bullnose assembly in relaxed and actuated configurations, respectively, according to one or more embodiments.
Figure 3B:
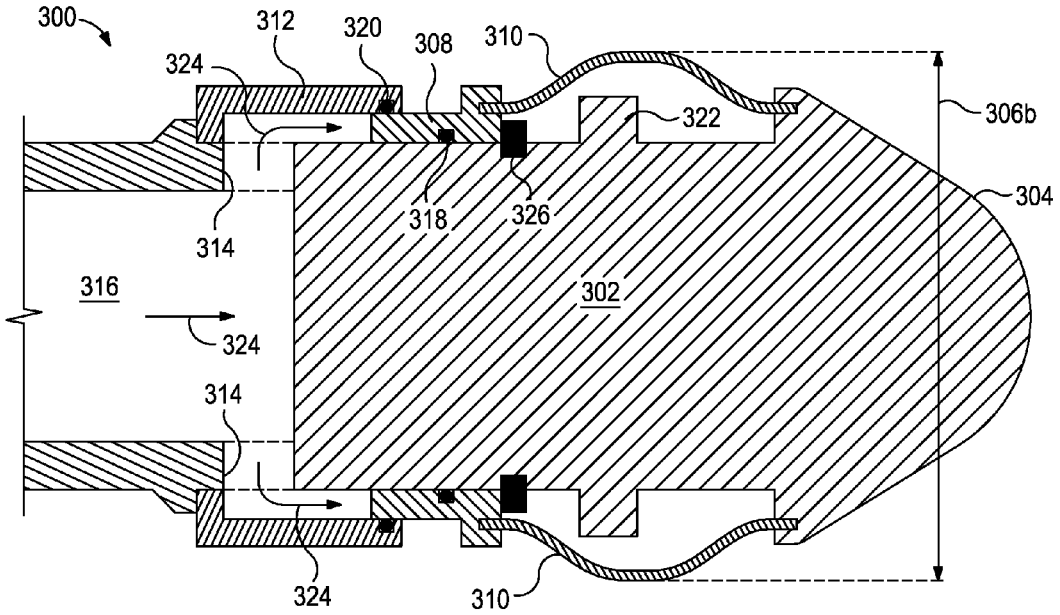

Referring now to FIGS. 3A and 3B, with continued reference to FIGS. 1 and 2A-2C, illustrated are cross-sectional side views of an exemplary bullnose assembly 300, according to one or more embodiments. The bullnose assembly 300 may constitute the distal end of a tool string (not shown), such as a bottom hole assembly or the like, that is conveyed downhole within the main bore 102 (FIG. 1). In some embodiments, the bullnose assembly 300 is conveyed downhole using coiled tubing. In other embodiments, however, the bullnose assembly 300 may be conveyed downhole using other types of conveyances such as, but not limited to, drill pipe, production tubing, or any other conveyance capable of being fluidly pressurized. In yet other embodiments, the conveyance may be wireline, slickline, or electrical line, without departing from the scope of the disclosure. The tool string may include various downhole tools and devices configured to perform or otherwise undertake various wellbore operations once accurately placed in the downhole environment. The bullnose assembly 300 may be configured to accurately guide the tool string downhole such that it reaches its target destination, e.g., the lateral bore 104 of FIG. 1 or further downhole within the main bore 102.

To accomplish this, the bullnose assembly 300 may include a body 302 and a bullnose tip 304 arranged at the distal end of the body 302. In some embodiments, the bullnose tip 304 may form an integral part of the body 302 as an integral extension thereof. As illustrated, the bullnose tip 304 may be rounded off at its distal end or otherwise angled or arcuate such that it does not present sharp corners or angled edges that might catch on obstructions within the main bore 102 or the deflector 112 (FIG. 1) as it is extended downhole.

The bullnose assembly 300 is shown in FIG. 3A in a default configuration and in FIG. 3B in an actuated configuration. In the default configuration, the bullnose assembly 300 generally exhibits a first diameter 306*a*, which may be less than the predetermined diameter 118 (FIGS. 1 and 2A-2C) of the first channel 116*a*. Consequently, when the bullnose assembly 300 is in the default configuration, it may be sized such that it is able to extend into the first channel 116*a* and further into lower portions of the main bore 102. In contrast, when the bullnose assembly 300 is in the actuated configuration, as shown in FIG. 3B, the bullnose assembly 300 may exhibit a second diameter 306*b* that is greater than the first diameter 306*a*, and also greater than the predetermined diameter 118 (FIGS. 1 and 2A-2C) of the first channel 116*a*. Consequently, when the bullnose assembly 300 is in the actuated configuration, it may be sized such that it will be directed into the second channel 116*b* via the ramped surface 120 (FIGS. 2A-2C) and subsequently into the lateral bore 104.

In the illustrated embodiment, the bullnose assembly 300 may include a compression ring 308 and a plurality of collet fingers 310 (two shown) extending between the compression ring 308 and the bullnose tip 304. The compression ring 308 may be movably arranged about the body 302 and configured to axially translate with respect to the body 302 upon being acted upon. The compression ring 308 may be radially secured against the body 302 using a retaining nut 312 or the like. The retaining nut 312 may be fixedly coupled to the body 302 at one end and movably coupled to the compression ring 308 at the opposing end such that the compression ring 308 is able to axially translate.

The retaining nut 312 may extend axially and radially between the body 302 and the compression ring 308 and axially span one or more fluid ports 314 (two shown) defined in the body 302. The fluid ports 314 may be configured to place the compression ring 308 in fluid communication with an interior 316 of the body such that pressurized hydraulic fluid from the interior 316 is able to act on the compression ring 308 when desired.

The compression ring 308 may include one or more sealing elements 318 that interpose the compression ring 308 and the body 302 such that a sealed interface therebetween is generated as the compression ring 308 axially translates. Similarly, the retaining nut 312 may also include one or more sealing elements 320 that interpose the compression ring 308 and the retaining nut 312 such that a sealed interface therebetween is generated as the compression ring 308 axially translates. The sealing elements 318, 320 may be O-rings, for example, or any other type of dynamic sealing device known to those skilled in the art.

The collet fingers 310 may be laterally spaced from each other about the circumference of the body 302 and may be coupled to the compression ring 308 and the bullnose tip 304 at opposing ends thereof. As illustrated, the collet fingers 310 may be pre-compressed or otherwise bowed radially outwards such that they are predisposed to bow further outwards in the radial direction upon sustaining an axial load from the compression ring 308.

In some embodiments, the body 302 may include a radial shoulder 322 used to prop and maintain the collet fingers 310 in the pre-compressed configuration. In the default configuration (FIG. 3A), the collet fingers 310 may engage or otherwise sit on the radial shoulder 322 such that the bullnose assembly 300 is able to generally exhibit the first diameter 306*a*. In other embodiments, the radial shoulder 322 may be omitted and the collet fingers 310 may instead be maintained in the pre-compressed configuration with only the compression ring 308.

In order to move the bullnose assembly 300 from its default configuration (FIG. 3A) into its actuated configuration (FIG. 3B), the compression ring 308 may be actuated such that it forces the collet fingers 310 to bow radially outward to the second diameter 306*b*. In some embodiments, this may be accomplished by conveying hydraulic fluid 324 from a surface location, through the conveyance (i.e., coiled tubing, drill pipe, production tubing, etc.) coupled to the bullnose assembly 300, and from the conveyance to the interior 316 of the body 302. The hydraulic fluid 324 may pass through the fluid ports 314 defined in the body 302 and subsequently act on the compression ring 308 such that the compression ring 308 axially translates toward the bullnose tip 304 (i.e., to the right in FIGS. 3A and 3B). In some embodiments, axial translation of the compression ring 308 may stop upon contacting one or more stop rings 326 defined on or otherwise forming part of the body 302. The stop rings 326 may be radial shoulders defined on the outer surface of the body 302. Alternatively the stop rings 326 may be snap rings coupled to the outer surface of the body 302, without departing from the scope of the disclosure.

As the compression ring 308 moves toward the bullnose tip 304, the collet fingers 310 are compressed even further, thereby causing them to bow radially outward to the second diameter 306*b*. Once it is desired to return the bullnose assembly 300 to its default configuration, the hydraulic pressure on the bullnose assembly 300 may be released. Upon releasing the hydraulic pressure, the spring force built up in the collet fingers 310 may force the compression ring 308 back to its default position. As a result, the bullnose assembly 300 may be effectively returned to the first diameter 306*a*. As will be appreciated, such an embodiment allows a well operator to increase the overall diameter of the bullnose assembly 300 on demand while downhole simply by applying pressure through the conveyance and to the bullnose assembly 300.

Those skilled in the art, however, will readily recognize that several other methods may equally be used to actuate the compression ring 308 and thereby move the bullnose assembly 300 between the default configuration and the actuated configuration. For instance, although not depicted herein, the present disclosure also contemplates using one or more actuating devices to physically adjust the axial position of the compression ring 308 and thereby move the collet fingers 310 to the second diameter 306*b*. Such actuating devices may include, but are not limited to, mechanical actuators, electromechanical actuators, hydraulic actuators, pneumatic actuators, combinations thereof, and the like. Such actuators may be powered by a downhole power unit or the like, or otherwise powered from the surface via a control line or an electrical line. The actuating device (not shown) may be operatively coupled to the compression ring 308 and otherwise configured to move the compression ring 308 axially with respect to the body 302 and thereby force the collet fingers 310 radially outward.

Moreover, in some embodiments, the compression ring 308 may be omitted and an expandable bladder or vessel (not shown) may be used to radially expand the collet fingers 310 to the second diameter 306*b*. In such embodiments, the expandable bladder may form part of the body 302 and may be configured to receive the hydraulic fluid 324. Upon receiving the hydraulic fluid 324, the bladder may be configured to expand outward, engage the collet fingers 310, and force the collet fingers 310 to move radially the second diameter 306*b*.

Figure 4A:
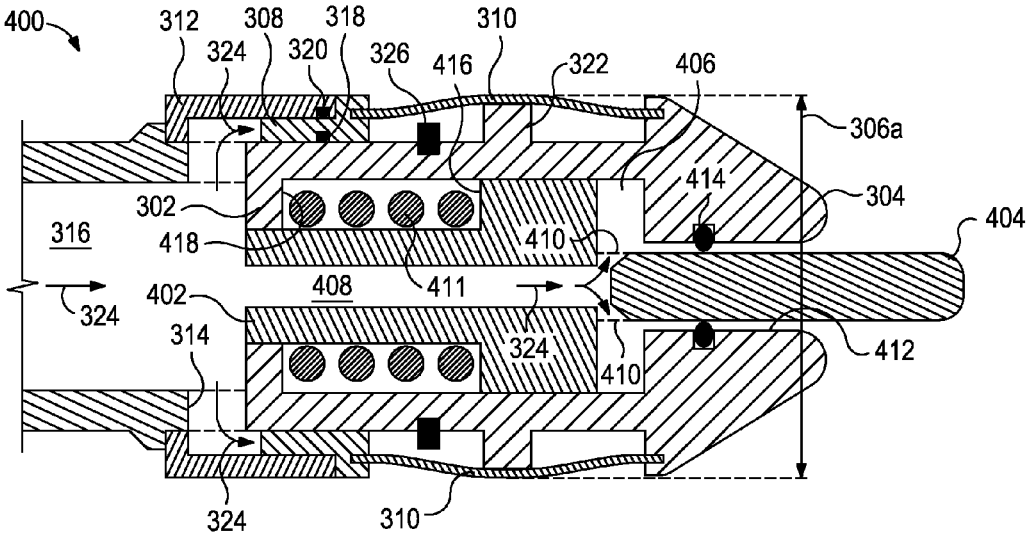
FIGS. 4A and 4B illustrate cross-sectional side views of another exemplary bullnose assembly in relaxed and actuated configurations, respectively, according to one or more embodiments.
Figure 4B:
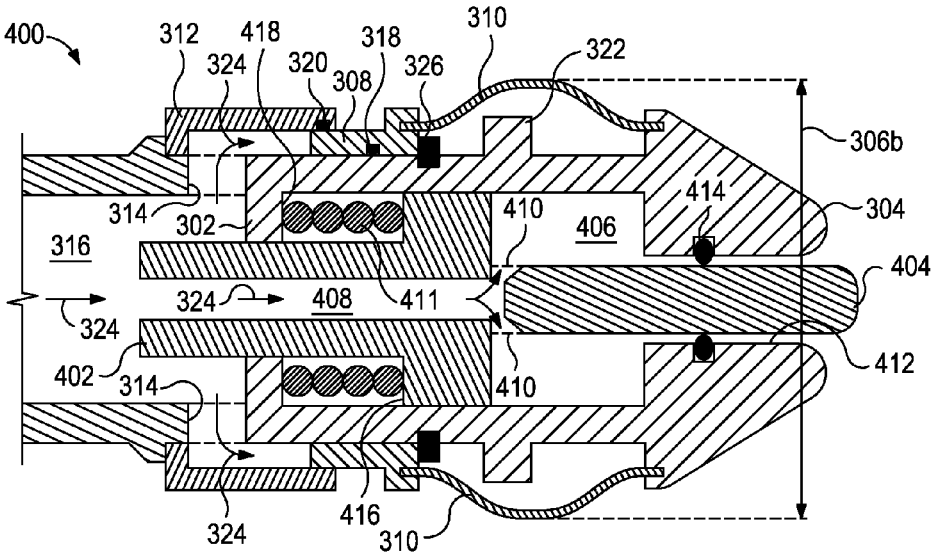

Referring now to FIGS. 4A and 4B, illustrated are cross-sectional side views of another exemplary bullnose assembly 400, according to one or more embodiments. The bullnose assembly 400 may be similar in some respects to the bullnose assembly 300 of FIGS. 3A and 3B and therefore may be best understood with reference thereto, where like numerals represent like elements not described again in detail. Similar to the bullnose assembly 300 of FIGS. 3A and 3B, the bullnose assembly 400 may include the body 302, the bullnose tip 304 arranged at the distal end of the body 302, the compression ring 308, and the plurality of collet fingers 310 extending between the compression ring 308 and the bullnose tip 304.

Unlike the bullnose assembly 300 of FIGS. 3A and 3B, however, the bullnose assembly 400 may further include a ported mandrel 402 and a bore finding nose 404 (hereafter "nose 404") extending longitudinally from the ported mandrel 402. As illustrated, the ported mandrel 402 may be movably arranged within a pressure chamber 406 defined within the body 302. The ported mandrel 402 may provide or otherwise define a fluid conduit 408 that extends longitudinally at least partially therethrough. One or more flow ports 410 (two shown) defined in the ported mandrel 402 may be configured to place the pressure chamber 406 in fluid communication with the interior 316 of the body 302 via the fluid conduit 408.

A biasing device 411 may be arranged axially between axial portions of both the ported mandrel 402 and the body 302. More particularly, the biasing device 411 may be arranged axially between an end wall 416 of the ported mandrel 402 and a radial protrusion 418 of the body 302. As illustrated, the end wall 416 protrudes radially outward from the centerline of the bullnose assembly 400 and the radial protrusion 418 protrudes radially inward toward the centerline. The biasing device 411 may be a helical compression spring, or the like.

The nose 404 may be configured to extend from the ported mandrel 402 through a channel 412 defined in the bullnose tip 304. When the bullnose assembly 400 is in the default configuration, as shown in FIG. 4A, the biasing device 411 may be configured to maintain the nose 404 in an extended configuration. When the bullnose assembly 400 is moved to the actuated configuration, however, as shown in FIG. 4B, the ported mandrel 402 may compress the biasing device 411 and the nose 404 may therefore be drawn at least partially into the body 302 and to a retracted configuration. One or more sealing elements 414 may be arranged between the bullnose tip 304 and the nose 404 such that a sealed interface therebetween is generated as the nose 404 axially translates within the channel 412. The sealing elements 414 may be O-rings, for example, or any other type of dynamic sealing device known to those skilled in the art.

In exemplary operation, the hydraulic fluid 324 may again be introduced into the bullnose assembly 400, as generally described above, in order to move the bullnose assembly 400 from its default configuration (FIG. 4A) into its actuated configuration (FIG. 4B). As described above, the hydraulic fluid 324 may move the compression ring 308 axially with respect to the body 302 and simultaneously axially compress the collet fingers 310, thereby causing them to bow radially outward to the second diameter 306*b*.

The hydraulic fluid 324 may also course through the fluid conduit 408 and into the pressure chamber 406 via the flow ports 410. As the hydraulic fluid 324 enters the pressure chamber 406, it acts on the piston area defined by the ported mandrel 402 and forces the ported mandrel 402 toward the radial protrusion 418 of the body 302, and thereby compressing the biasing device 411. Moving the ported mandrel 402 toward the radial protrusion 418 also serves to retract the nose 404 into the body 302 as it axially translates within the channel 412.

Once it is desired to return the bullnose assembly 400 again to its default configuration, the hydraulic pressure from the fluid 324 may be released, thereby allowing the spring force built up in the collet fingers 310 to force the compression ring 308 back to its default position such that the bullnose assembly 400 is returned to the first diameter 306*a*. Removing the hydraulic pressure may also allow the spring force built up in the biasing device 411 to axially move the ported mandrel 402 and thereby move the nose 404 back to its extended configuration.

As with the bullnose assembly 300, several other methods may equally be used to actuate the compression ring 308 and the nose 404 of the bullnose assembly 400 and thereby move the bullnose assembly 400 between the default and actuated configurations. For instance, one or more actuating devices (not shown), such as mechanical actuators, electromechanical actuators, hydraulic actuators, pneumatic actuators, and the like, may be used to physically adjust the axial position of the compression ring 308 and the nose 404.

As will be appreciated, the nose 404 may prove advantageous to an operator, especially in deviated wellbores. For instance, the extended nose 404 may help the bullnose assembly 400 locate a desired smaller bore, such as the first channel 116*a* of FIGS. 1 and 2A-2C, thereby preventing the bullnose assembly 400 from perhaps riding left or right within the main bore 102 and inadvertently up the ramped surface 120 and into the second channel 116*b*. Advantageously, the nose 404 may be actuated between its extended and actuated configurations by utilizing the same fluid pressure applied to expand the collet fingers 310. Moreover, the nose 404 exhibits a smaller outer diameter than the remaining portions of the bullnose assembly 400, and therefore requires a lot more deflection from the well bore centerline to miss the desired channel 116*a* or 116*b*. As a result, the chances of entering the correct channel 116*a* or 116*b* are increased even if the bullnose assembly 400 is advancing slightly off the wellbore centerline, such as may be the case in deviated or curved portions of the wellbore.

Figure 5A:
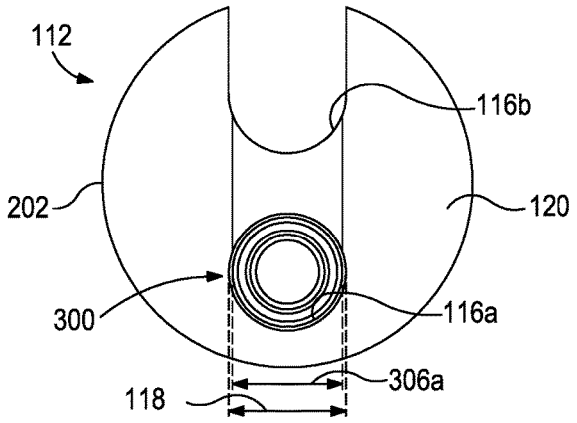
FIGS. 5A and 5B illustrate end and cross-sectional side views, respectively, of the bullnose assembly of FIGS. 3A-3B in its default configuration as it interacts with the deflector of FIGS. 1-2, according to one or more embodiments.
Figure 5B:
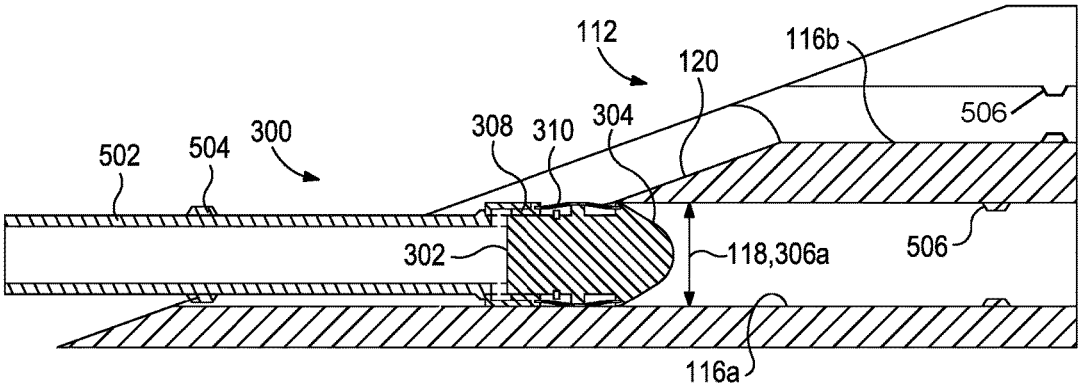
Figure 6A:
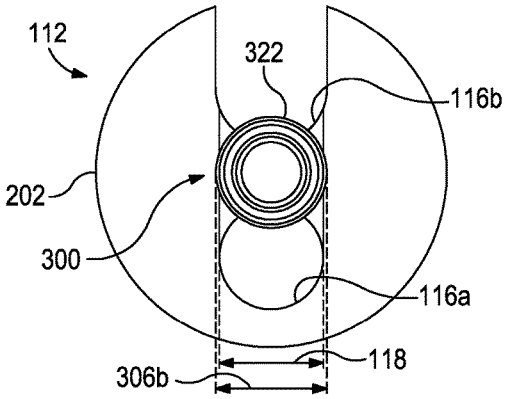
FIGS. 6A and 6B illustrate end and cross-sectional side views, respectively, of the bullnose assembly of FIGS. 3A-3B in its actuated configuration as it interacts with the deflector of FIGS. 1-2, according to one or more embodiments.
Figure 6B:
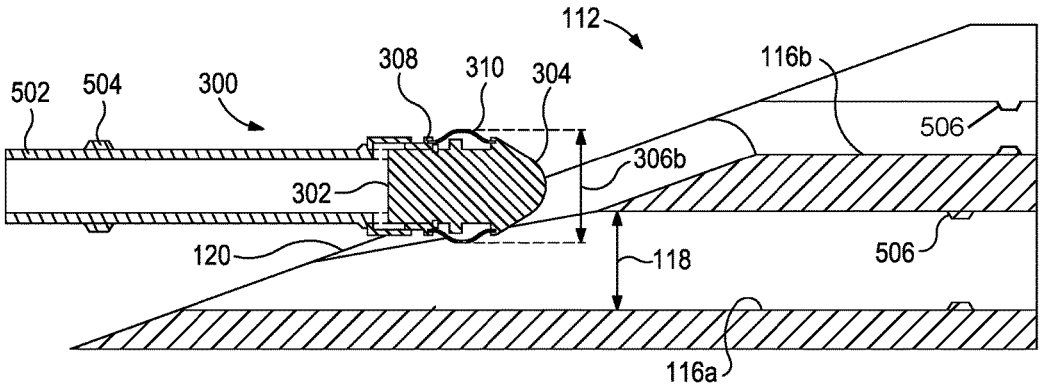

Referring now to FIGS. 5A-5B and 6A-6B, with continued reference to the prior figures, illustrated is the bullnose assembly 300 as it interacts with the deflector 112 of FIGS. 1 and 2A-2C, according to one or more embodiments. More particularly, FIGS. 5A and 5B depict end and side cross-sectional views, respectively, of the bullnose assembly 300 in its default configuration, and FIGS. 6A and 6B depict end and side cross-sectional views, respectively, of the bullnose assembly 300 in its actuated configuration. It will be appreciated that the bullnose assembly 300 may be replaced with the bullnose assembly 400 of FIGS. 4A and 4B, without departing from the scope of the disclosure. Accordingly, exemplary operation of the bullnose assembly 300 in conjunction with the deflector 112 should not be considered limiting to the present disclosure, but is instead one exemplary embodiment of expandable bullnose assemblies end and cross-sectional side views, respectively, of In FIGS. 5A-5B, the bullnose assembly 300 is shown in its default configuration where, as discussed above, the bullnose assembly 300 exhibits the first diameter 306*a*. The first diameter 306*a* may be less than the predetermined diameter 118 (FIGS. 1 and 2A-2C) of the first channel 116*a*. Consequently, in its default configuration the bullnose assembly 300 may be able to extend through the ramped surface 120 and otherwise into the first channel 116*a* where it will be guided into the lower portions of the main bore 102.

In FIGS. 6A and 6B, the bullnose assembly 300 is shown in its actuated configuration where, as discussed above, the collet fingers 310 have been forced radially outward and thereby effectively increases the diameter of the bullnose assembly 300 from the first diameter 306*a* (FIGS. 5A-5B) to the second diameter 306*b*. The second diameter 306*b* is greater than the predetermined diameter 118 (FIGS. 1 and 2A-2C) of the first channel 116*a*. Consequently, upon encountering the deflector 112 in the actuated configuration, the bullnose assembly 300 is prevented from entering the first channel 116*a*, but instead slidingly engages the ramped surface 120 which serves to deflect the bullnose assembly 300 into the second channel 116*b* and subsequently into the lateral bore 104 (FIG. 1).

Still referring to FIGS. 5A-5B and 6A-6B, the bullnose assembly 300 is further depicted as being run on a conveyance 502. As indicated above, the conveyance 502 may be, but is not limited to, coiled tubing, drill pipe, production tubing, or any other conveyance capable of being fluidly pressurized. In the illustrated embodiment, the conveyance 502 may further include or otherwise have defined thereon a colleted shoulder 504 arranged above the bullnose assembly 300. The colleted shoulder 504 may be configured to interact or interface with a profile 506 provided in the inner diameter of the main bore 102 below the deflector 112 or alternatively with a profile 506 provided in the inner diameter of the lateral bore 104, as described below. In the illustrated embodiment, the profiles 506 are depicted as being positioned within the corresponding first and second channels 116*a,b*, thereby representing being provided in the inner diameter of the main and lateral bores 102, 104, respectively.

In some embodiments, the profiles 506 may be in the form of an upset or radial shoulder. In other embodiments, the profiles 506 may be in the form of a set of upsets or radial shoulders axially arranged in a predetermined configuration. As the bullnose assembly 300 proceeds downhole and past a particular profile 506, the colleted shoulder 504 may be configured to axially engage the profile 506 and otherwise interact therewith. In some embodiments, collet fingers (not depicted) of the colleted shoulder 504 may be pushed into the profile 506, thereby briefly holding up axial movement of the bullnose assembly 300. This will create a tag confirmation by weight seen (i.e., measurable) at the surface so that a well operator may be able to positively confirm that the bullnose assembly 300 has encountered the particular profile 506. Continued axial load on the bullnose assembly 300 from the surface via the conveyance 502 will allow the bullnose assembly 300 to disengage from the profile 506 and continue its axial movement within the main bore 102.

As will be appreciated, a multilateral well may be configured such that there is, for example, one profile 506 provided in the main bore 102 and two profiles 506 (only one shown) provided in the lateral bore 104. As a result, a well operator may be apprised in real-time as to which bore 102, 104 the bullnose assembly 300 has entered by counting how many weight tag confirmations are seen (i.e., measured) at the surface. If, for example, there is one weight tag confirmation seen at the surface, the well operator may be assured that the bullnose assembly 300 has successfully bypassed the deflector 112 in the first channel 116*a* and is proceeding further downhole within the main bore 102. Alternatively, if there are two weight tag confirmations seen at the surface, the well operator may be assured that the bullnose assembly 300 has successfully bypassed the deflector 112 in the second channel 116*b* and is proceeding further downhole within the lateral bore 104.

Figure 7:
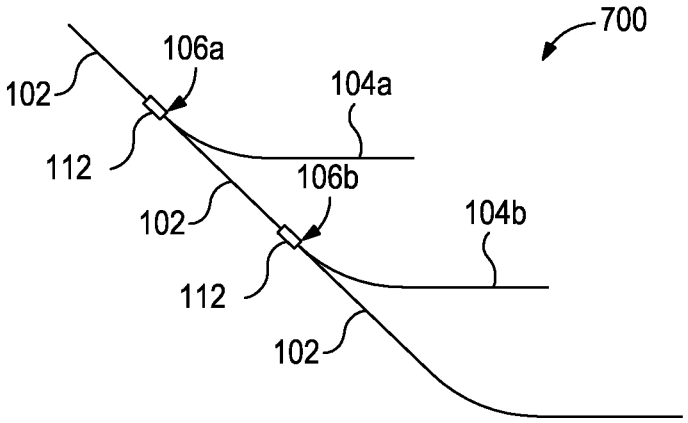
FIG. 7 illustrates an exemplary multilateral wellbore system that may implement the principles of the present disclosure.

Referring to FIG. 7, with continued reference to the previous figures, illustrated is an exemplary multilateral wellbore system 700 that may implement the principles of the present disclosure. The wellbore system 700 may include a main bore 102 that extends from a surface location (not shown) and passes through at least two junctions 106 (shown as a first junction 106*a* and a second junction 106*b*). While two junctions 106*a,b* are shown in the wellbore system 700, it will be appreciated that more than two junctions 106*a,b* may be utilized, without departing from the scope of the disclosure.

At each junction 106*a,b*, a lateral bore 104 (shown as first and second lateral bores 104*a* and 104*b*, respectively) extends from the main bore 102. The deflector 112 of FIGS. 2A-2C may be arranged at each junction 106*a,b*. Accordingly, each junction 106*a,b* includes a deflector 112 having a first channel 116*a* that exhibits a first diameter 118 and a second channel 116*b*.

In exemplary operation, an expandable bullnose assembly, such as the bullnose assemblies 300, 400 described herein, may be introduced downhole and actuated in order to enter the first and second lateral bores 104*a,b* at each junction 106*a,b*, respectively. For instance, if it is desired to enter the first lateral bore 104*a*, the bullnose assembly 300, 400 may be actuated prior to reaching the deflector 112 at the first junction 106*a*. As a result, the bullnose assembly 300, 400 will exhibit the second diameter 306*b* and thereby be directed into the second channel 116*b* since the second diameter 306*b* is greater than the predetermined diameter 118 of the first channel 116*a*. Otherwise, the bullnose assembly 300, 400 may remain in its default configuration with the first diameter 306*a* and pass through the first channel 116*a* of the deflector 112 at the first junction 106*a*.

Once past the first junction 106*a*, the bullnose assembly 300, 400 may enter the second lateral bore 104*b* by being actuated prior to reaching the deflector 112 at the second junction 106*b*. As a result, the bullnose assembly 300, 400 will again exhibit the second diameter 306*b* and thereby be directed into the second channel 116*b* at the deflector 112 of the second junction 106*b* since the second diameter 306*b* is greater than the predetermined diameter 118 of the first channel 116*a*. If it is desired to pass through the deflector 112 of the second junction 106*b* and into the lower portions of the main bore 102, the bullnose assembly 300, 400 may remain in its default configuration with the first diameter 306*a* and pass through the first channel 116*a* of the deflector 112 at the second junction 106*b*.

As will be appreciated, by varying the outer diameter of the bullnose assembly 300, 400 to enter multiple lateral bores 104*a,b* of a stacked multilateral wellbore system 700, approximately one additional trip per lateral entered is saved. This due to the fact that the bullnose assembly 300, 400 is able to selectively enter multiple lateral bores 104*a,b* based on its changeable outer diameter. As a result, there is no need to select and install different bullnose assemblies for each lateral bore 104*a,b*. Instead, the bullnose assembly 300, 400 may be configured to access any lateral bore 104*a,b* in a single downhole trip. Also, given the simple nature of actuating the bullnose assembly 300, 400, it can be made up to the bottom of any downhole tool with a connection on the bottom that allows fluid flow to pass therethrough and to the bullnose assembly 300, 400. This allows the bullnose assembly 300, 400 to be used in a variety of intervention operations such as logging, stimulation, perforating, acid treatments, tagging wellbore depths, moving sliding sleeves, engaging or otherwise physically interacting with various downhole tools within a wellbore, etc. Many of these operations would not be possible if the activation requirement was by means of a ball drop, for example.

Moreover, using the presently-disclosed variable diameter bullnose assemblies 300, 400, lateral wellbores 104*a,b* may be stacked using the same design of the deflector 112 exhibiting the same predetermined diameter 118 for the first channel 116*a*. In the case of fixed diameter bullnose assemblies, for instance, the access channels for the main bore 102 and each lateral bore 104 would have to be smaller and smaller at each deeper junction in order to enable a bullnose small enough to run through all upper junctions until reaching a matched diameter ramp to be deflected. Furthermore, as well as requiring a specific bullnose size for each deflector, flow restrictions would inadvertently be created at the deeper junctions due to their required reduction in inner diameter for each deflector. According to the presently described embodiments, the variable diameter bullnose assemblies 300, 400 removes the need for inner diameter reductions (and therefore flow restrictions) and sets of different fixed outer diameter bullnoses.

Embodiments disclosed herein include:

A. A bullnose assembly that includes a body and a bullnose tip arranged at a distal end of the body, a compression ring arranged about an exterior of the body and configured to axially translate with respect to the body upon being actuated, and a plurality of collet fingers coupled to and extending between the compression ring and the bullnose tip, each collet finger being pre-compressed such that each collet finger is predisposed to bow radially outwards, wherein, when the compression ring is actuated, the plurality of collet fingers move radially outward from a first diameter to a second diameter that is greater than the first diameter.

B. A well system that includes a deflector arranged within a main bore of a wellbore and defining a first channel that exhibits a predetermined diameter and communicates with a lower portion of the main bore, and a second channel that communicates with a lateral bore, and a bullnose assembly comprising a body and a bullnose tip arranged at a distal end of the body, a compression ring movably arranged about an exterior of the body, and a plurality of collet fingers coupled to and extending between the compression ring and the bullnose tip, each collet finger being pre-compressed such that each collet finger is predisposed to bow radially outwards, wherein the bullnose assembly is actuatable between a default configuration, where the plurality of collet fingers exhibits a first diameter equal to or less than the predetermined diameter, and an actuated configuration, where the plurality of collet fingers exhibits a second diameter greater than the first diameter, and wherein the deflector is configured to direct the bullnose assembly into one of the lateral bore and the lower portion of the main bore based on a diameter of the plurality of collet fingers as compared to the predetermined diameter.

C. A method that includes introducing a bullnose assembly coupled to a conveyance into a wellbore having a main bore and a lateral bore that extends from the main bore at a junction, the bullnose assembly comprising a body and a bullnose tip arranged at a distal end of the body, a compression ring movably arranged about an exterior of the body, and a plurality of collet fingers coupled to and extending between the compression ring and the bullnose tip, each collet finger being pre-compressed such that each collet finger is predisposed to bow radially outwards, conveying the bullnose assembly to a deflector arranged at the junction, the deflector being arranged within the main bore and defining a first channel that exhibits a predetermined diameter and communicates with a lower portion of the main bore, and a second channel that communicates with the lateral bore, and selectively actuating the bullnose assembly at the junction in order to vary an outer diameter of the bullnose assembly as compared to the predetermined diameter and thereby directing the bullnose assembly into either the first channel or the second channel based on the outer diameter of the bullnose assembly.

Each of embodiments A, B, and C may have one or more of the following additional elements in any combination: Element 1: wherein the compression ring is actuatable using at least one of hydraulic pressure acting on the compression ring and an actuating device operatively coupled to the compression ring. Element 2: further comprising a retaining nut fixedly coupled to the body and radially securing the compression ring against the exterior of the body as the compression ring axially translates. Element 3: wherein the retaining nut extends axially between the body and the compression ring and axially spans one or more fluid ports defined in the body, the one or more fluid ports being configured to place the compression ring in fluid communication with an interior of the body such that hydraulic fluid can act on and actuate the compression ring. Element 4: further comprising a ported mandrel movably arranged within a pressure chamber defined within the body, the ported mandrel having a fluid conduit defined at least partially therethrough, one or more flow ports defined in the ported mandrel and configured to place the pressure chamber in fluid communication with an interior of the body via the fluid conduit, and a bore finding nose extending longitudinally from the ported mandrel and through a channel defined in the bullnose tip, the bullnose tip being configured to be moved between an extended configuration, where the ported mandrel maintains the nose extended out of the bullnose tip, and a retracted configuration, where the ported mandrel is axially moved and draws the bore finding nose at least partially within the body. Element 5: further comprising a biasing device arranged axially between an end wall of the ported mandrel and a radial protrusion of the body.

Element 6: wherein the deflector further includes a ramped surface that guides the bullnose assembly to the second channel when the plurality of collet fingers exhibits the second diameter. Element 7: wherein, when the plurality of collet fingers exhibits the first diameter, the bullnose assembly is directed into the first channel and the lower portion of the main bore, and wherein, when the plurality of collet fingers tip exhibits the second diameter, the bullnose assembly is directed into the second channel and the lateral bore. Element 8: wherein the compression ring is actuatable using at least one of hydraulic pressure acting on the compression ring and an actuating device operatively coupled to the compression ring. Element 9: further comprising a retaining nut fixedly coupled to the body and radially securing the compression ring against the exterior of the body as the compression ring axially translates. Element 10: wherein the retaining nut extends axially between the body and the compression ring and axially spans one or more fluid ports defined in the body, the one or more fluid ports being configured to place the compression ring in fluid communication with an interior of the body such that hydraulic fluid can act on and actuate the compression ring. Element 11: further comprising a ported mandrel movably arranged within a pressure chamber defined within the body, the ported mandrel having a fluid conduit defined at least partially therethrough, one or more flow ports defined in the ported mandrel and configured to place the pressure chamber in fluid communication with an interior of the body via the fluid conduit, and a bore finding nose extending longitudinally from the ported mandrel and through a channel defined in the bullnose tip, the bullnose tip being configured to be moved between an extended configuration, where the ported mandrel maintains the nose extended out of the bullnose tip, and a retracted configuration, where the ported mandrel is axially moved and draws the bore finding nose at least partially within the body. Element 12: further comprising a biasing device arranged axially between an end wall of the ported mandrel and a radial protrusion of the body. Element 13: further comprising a conveyance coupled to the bullnose assembly and configured to convey the bullnose assembly into the wellbore, a colleted shoulder defined on the conveyance above the bullnose assembly; a first profile provided on an inner diameter of the lower portion of the main bore below the deflector, and a second profile different than the first profile and provided in an inner diameter of the lateral bore, wherein, as the colleted shoulder engages the first or second profiles, a tag confirmation by weight is measurable at a wellbore surface location to positively indicate whether the bullnose assembly is in either the lower portion of the main bore or the lateral bore.

Element 14: wherein selectively actuating the bullnose assembly comprises selectively actuating the bullnose assembly between a default configuration, where the plurality of collet fingers exhibits a first diameter equal to or less than the predetermined diameter, and an actuated configuration, where the plurality of collet fingers exhibits a second diameter greater than the first diameter. Element 15: further comprising directing the bullnose assembly into the first channel and the lower portion of the main bore when the plurality of collet fingers exhibits the first diameter, and directing the bullnose assembly into the second channel and the lateral bore when the plurality of collet fingers exhibits the second diameter. Element 16: wherein selectively actuating the bullnose assembly comprises conveying hydraulic fluid through the conveyance to an interior of the body, communicating the hydraulic fluid with the compression ring via one or more fluid ports defined in the body, axially moving the compression ring toward the bullnose tip with the hydraulic fluid, and thereby compressing the plurality of collet fingers from the first diameter to the second diameter. Element 17: further comprising decreasing a pressure of the hydraulic fluid within the conveyance and thereby allowing a spring force built up in the plurality of collet fingers to move the compression ring and back to the first diameter. Element 18: wherein the bullnose assembly further comprises a ported mandrel movably arranged within a pressure chamber defined within the body and a bore finding nose extending longitudinally from the ported mandrel and through a channel defined in the bullnose tip, the method further comprising conveying the bullnose assembly within the wellbore with the bore finding nose in an extended configuration, where a biasing device acts on the ported mandrel and thereby maintains the nose extended out of the bullnose tip, finding a desired one of the first or second channels with the bore finding nose in the extended configuration, selectively actuating the bullnose assembly in order to move the bore finding nose from the extended configuration to a retracted configuration, where the ported mandrel is axially moved and draws the bore finding nose at least partially within the body. Element 19: wherein selectively actuating the bullnose assembly in order to move the bore finding nose from the extended configuration to the retracted configuration comprises conveying hydraulic fluid through the conveyance to an interior of the body, communicating the hydraulic fluid with the pressure chamber via a fluid conduit defined at least partially through the ported mandrel and one or more flow ports defined in the ported mandrel, and hydraulically moving the ported mandrel with the hydraulic fluid, and thereby retracting the bore finding nose at least partially into the nose as it axially translates within the channel. Element 20: wherein the conveyance has a colleted shoulder defined thereon above the bullnose assembly, the method further comprising engaging a first profile or set of first profiles provided on an inner diameter of the lower portion of the main bore below the deflector when the bullnose assembly enters the lower portion of the main bore and thereby providing a first tag confirmation by weight measurable at a wellbore surface location to positively indicate that the bullnose assembly is in the lower portion of the main bore, and engaging a second profile or set of second profiles provided on an inner diameter of the lateral bore when the bullnose assembly enters the lateral bore thereby providing a second tag confirmation by weight measurable at the wellbore surface location to positively indicate that the bullnose assembly is in the lateral bore.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A bullnose assembly, comprising:

a body and a bullnose tip arranged at a distal end of the body;

a compression ring arranged about an exterior of the body and movable with respect to the body upon being actuated; and a plurality of collet fingers directly coupled to and extending between the compression ring and the bullnose tip, each collet finger being pre-compressed such that each collet finger is predisposed to bow radially outwards, wherein, when the compression ring is actuated, the plurality of collet fingers move radially outward from a first diameter to a second diameter that is greater than the first diameter.

2. The bullnose assembly of claim 1, wherein the compression ring is actuatable using hydraulic pressure acting on the compression ring.

3. The bullnose assembly of claim 1, further comprising a retaining nut fixedly coupled to the body and radially securing the compression ring against the exterior of the body as the compression ring axially translates.

4. The bullnose assembly of claim 3, wherein the retaining nut extends axially between the body and the compression ring and axially spans one or more fluid ports defined in the body, the one or more fluid ports being configured to place the compression ring in fluid communication with an interior of the body such that hydraulic fluid can act on and actuate the compression ring.

5. The bullnose assembly of claim 1, further comprising:

a ported mandrel movably arranged within a pressure chamber defined within the body, the ported mandrel having a fluid conduit defined at least partially therethrough;

one or more flow ports defined in the ported mandrel and configured to place the pressure chamber in fluid communication with an interior of the body via the fluid conduit; and a bore finding nose extending longitudinally from the ported mandrel and through a channel defined in the bullnose tip, the bullnose tip being configured to be moved between an extended configuration, where the ported mandrel maintains the nose extended out of the bullnose tip, and a retracted configuration, where the ported mandrel is axially moved and draws the bore finding nose at least partially within the body.

6. The bullnose assembly of claim 5, further comprising a biasing device arranged axially between an end wall of the ported mandrel and a radial protrusion of the body.

7. A well system, comprising:

a deflector arranged within a main bore of a wellbore and defining a first channel that exhibits a predetermined diameter and communicates with a lower portion of the main bore, and a second channel that communicates with a lateral bore; and a bullnose assembly comprising a body and a bullnose tip arranged at a distal end of the body, a compression ring movably arranged about an exterior of the body, and a plurality of collet fingers coupled to and extending between the compression ring and the bullnose tip, each collet finger being pre-compressed such that each collet finger is predisposed to bow radially outwards, wherein the bullnose assembly is actuatable between a default configuration, where the plurality of collet fingers exhibits a first diameter equal to or less than the predetermined diameter, and an actuated configuration, where the plurality of collet fingers exhibits a second diameter greater than the first diameter, and wherein the deflector is configured to direct the bullnose assembly into one of the lateral bore and the lower portion of the main bore based on a diameter of the plurality of collet fingers as compared to the predetermined diameter.

8. The well system of claim 7, wherein the deflector further includes a ramped surface that guides the bullnose assembly to the second channel when the plurality of collet fingers exhibits the second diameter.

9. The well system of claim 8, further comprising:

a ported mandrel movably arranged within a pressure chamber defined within the body, the ported mandrel having a fluid conduit defined at least partially therethrough;

one or more flow ports defined in the ported mandrel and configured to place the pressure chamber in fluid communication with an interior of the body via the fluid conduit; and a bore finding nose extending longitudinally from the ported mandrel and through a channel defined in the bullnose tip, the bullnose tip being configured to be moved between an extended configuration, where the ported mandrel maintains the nose extended out of the bullnose tip, and a retracted configuration, where the ported mandrel is axially moved and draws the bore finding nose at least partially within the body.

10. The well system of claim 9, further comprising a biasing device arranged axially between an end wall of the ported mandrel and a radial protrusion of the body.

11. The well system of claim 7, wherein, when the plurality of collet fingers exhibits the first diameter, the bullnose assembly is directed into the first channel and the lower portion of the main bore, and wherein, when the plurality of collet fingers tip exhibits the second diameter, the bullnose assembly is directed into the second channel and the lateral bore.

12. The well system of claim 7, wherein the compression ring is actuatable using hydraulic pressure acting on the compression ring.

13. The well system of claim 7, further comprising a retaining nut fixedly coupled to the body and radially securing the compression ring against the exterior of the body as the compression ring axially translates.

14. The well system of claim 13, wherein the retaining nut extends between the body and the compression ring and axially spans one or more fluid ports defined in the body, the one or more fluid ports being configured to place the compression ring in fluid communication with an interior of the body such that hydraulic fluid can act on and actuate the compression ring.

15. The well system of claim 7, further comprising:

a conveyance coupled to the bullnose assembly and configured to convey the bullnose assembly into the wellbore;

a colleted shoulder defined on the conveyance above the bullnose assembly;

a first profile provided on an inner diameter of the lower portion of the main bore below the deflector; and a second profile different than the first profile and provided in an inner diameter of the lateral bore, wherein, as the colleted shoulder engages the first or second profiles, a tag confirmation by weight is measurable at a wellbore surface location to positively indicate whether the bullnose assembly is in either the lower portion of the main bore or the lateral bore.

16. A method, comprising:

introducing a bullnose assembly coupled to a conveyance into a wellbore having a main bore and a lateral bore that extends from the main bore at a junction, the bullnose assembly comprising:

a body and a bullnose tip arranged at a distal end of the body;

a compression ring movably arranged about an exterior of the body; and a plurality of collet fingers coupled to and extending between the compression ring and the bullnose tip, each collet finger being pre-compressed such that each collet finger is predisposed to bow radially outwards;

conveying the bullnose assembly to a deflector arranged at the junction, the deflector being arranged within the main bore and defining a first channel that exhibits a predetermined diameter and communicates with a lower portion of the main bore, and a second channel that communicates with the lateral bore; and selectively actuating the bullnose assembly in order to vary an outer diameter of the bullnose assembly as compared to the predetermined diameter and thereby directing the bullnose assembly into either the first channel or the second channel based on the outer diameter of the bullnose assembly.

17. The method of claim 16, wherein selectively actuating the bullnose assembly comprises selectively actuating the bullnose assembly between a default configuration, where the plurality of collet fingers exhibits a first diameter equal to or less than the predetermined diameter, and an actuated configuration, where the plurality of collet fingers exhibits a second diameter greater than the first diameter.

18. The method of claim 17, further comprising:

directing the bullnose assembly into the first channel and the lower portion of the main bore when the plurality of collet fingers exhibits the first diameter; and directing the bullnose assembly into the second channel and the lateral bore when the plurality of collet fingers exhibits the second diameter.

19. The method of claim 16, wherein selectively actuating the bullnose assembly comprises:

conveying hydraulic fluid through the conveyance to an interior of the body;

communicating the hydraulic fluid with the compression ring via one or more fluid ports defined in the body;

axially moving the compression ring toward the bullnose tip with the hydraulic fluid, and thereby compressing the plurality of collet fingers from the first diameter to the second diameter.

20. The method of claim 19, further comprising decreasing a pressure of the hydraulic fluid within the conveyance and thereby allowing a spring force built up in the plurality of collet fingers to move the compression ring and move the plurality of collet fingers back to the first diameter.

21. The method of claim 16, wherein the bullnose assembly further comprises a ported mandrel movably arranged within a pressure chamber defined within the body and a bore finding nose extending longitudinally from the ported mandrel and through a channel defined in the bullnose tip, the method further comprising:

conveying the bullnose assembly within the wellbore with the bore finding nose in an extended configuration, where a biasing device acts on the ported mandrel and thereby maintains the nose extended out of the bullnose tip;

finding a desired one of the first or second channels with the bore finding nose in the extended configuration;

selectively actuating the bullnose assembly in order to move the bore finding nose from the extended configuration to a retracted configuration, where the ported mandrel is axially moved and draws the bore finding nose at least partially within the body.

22. The method of claim 21, wherein selectively actuating the bullnose assembly in order to move the bore finding nose from the extended configuration to the retracted configuration comprises:

conveying hydraulic fluid through the conveyance to an interior of the body;

communicating the hydraulic fluid with the pressure chamber via a fluid conduit defined at least partially through the ported mandrel and one or more flow ports defined in the ported mandrel; and hydraulically moving the ported mandrel with the hydraulic fluid, and thereby retracting the bore finding nose at least partially into the nose as it axially translates within the channel.

23. The method of claim 16, wherein the conveyance has a colleted shoulder defined thereon above the bullnose assembly, the method further comprising:

engaging a first profile or set of first profiles provided on an inner diameter of the lower portion of the main bore below the deflector when the bullnose assembly enters the lower portion of the main bore and thereby providing a first tag confirmation by weight measurable at a wellbore surface location to positively indicate that the bullnose assembly is in the lower portion of the main bore; and engaging a second profile or set of second profiles provided on an inner diameter of the lateral bore when the bullnose assembly enters the lateral bore thereby providing a second tag confirmation by weight measurable at the wellbore surface location to positively indicate that the bullnose assembly is in the lateral bore.

* * * * *